United States Patent [19]

Harris et al.

[11] Patent Number: 4,685,412

[45] Date of Patent: Aug. 11, 1987

[54] SUBMARINE WEAPON DOLLY WITH SELF STOWING BANDS

[75] Inventors: Robert M. Harris, New Hope; Neil G. Anderson, Minnetonka, both of Minn.

[73] Assignee: FMC Corporation, Chicago, Ill.

[21] Appl. No.: 829,262

[22] Filed: Feb. 14, 1986

[51] Int. Cl.[4] ..... B63G 8/32

[52] U.S. Cl. ..... 114/238; 114/316; 410/47

[58] Field of Search ..... 114/238, 239, 316, 318; 410/49, 47, 50; 244/118.1; 414/589, 590; 24/483, 484; 89/1.58, 1.59, 1.805, 1.801, 1.802, 1.804

[56] References Cited

U.S. PATENT DOCUMENTS 2,914,831 12/1959 McBrien ..... 24/483 X 4,184,801 1/1980 Nicoloff et al. ..... 114/238 X

*Primary Examiner*—Sherman D. Basinger

*Attorney, Agent, or Firm*—A. J. Moore; H. M. Stanley; R. B. Megley

[57] ABSTRACT

A weapon dolly is disclosed for use in a submarine to handle weapons such as torpedos or the like. The dolly includes a base section having an arcuate weapon supporting surface formed from light composite material having a recess formed therein. A composite arcuate band is movable between a weapon clamping position above the base section and a stowed position slidably received within the base section below the weapon supporting surface. Arcuate links and clamp means with an associated positive locking mechanism are provided for clamping the weapon between the band and the base and for quickly releasing the weapon for movement into a launching tube or the like.

30 Claims, 7 Drawing Figures

FIG_1
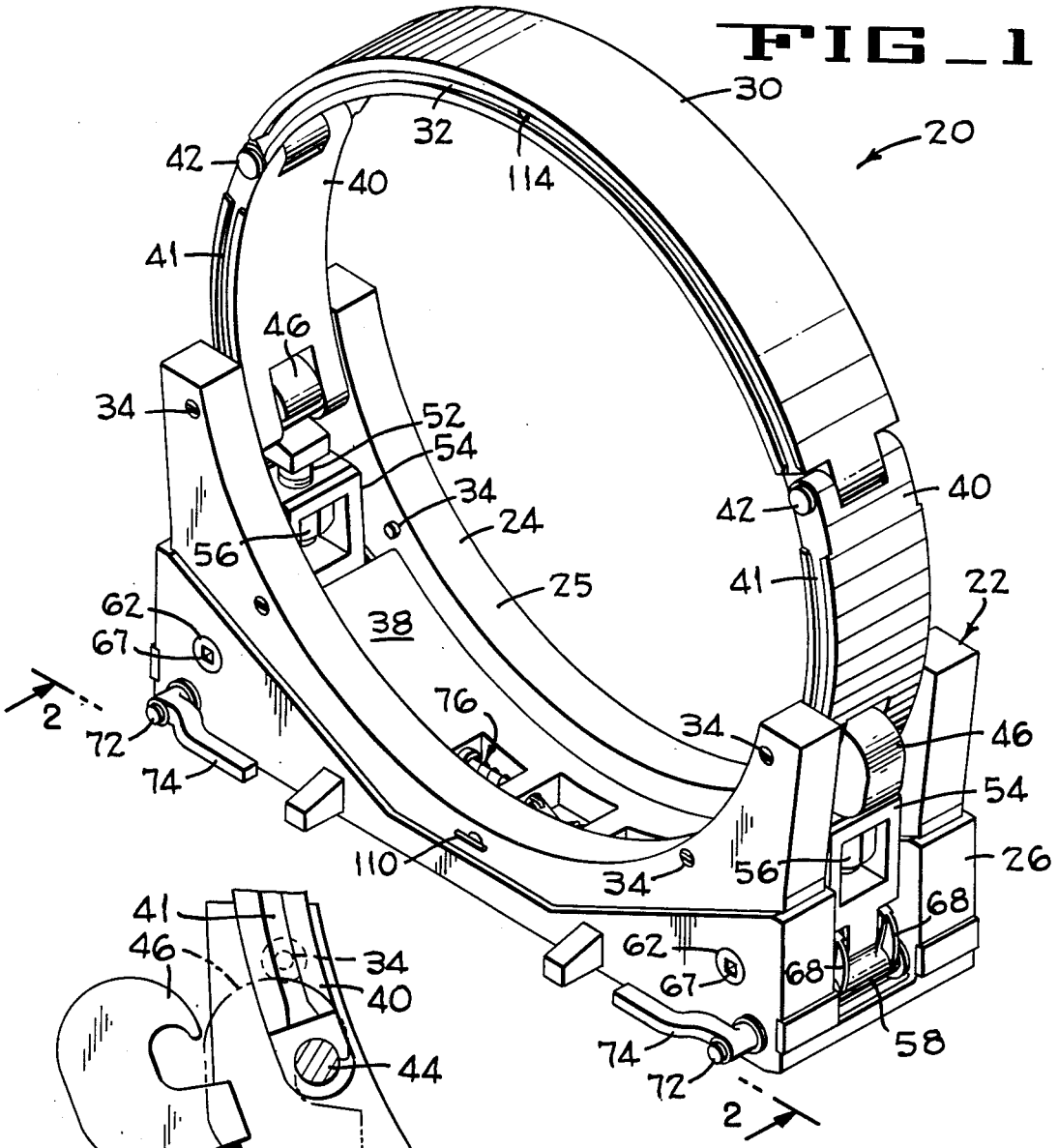
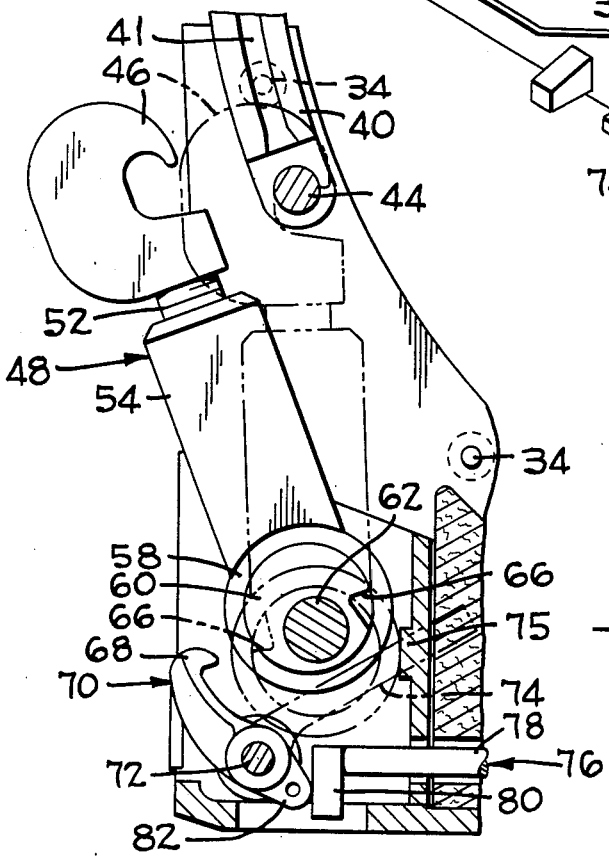
FIG_6

SUBMARINE WEAPON DOLLY WITH SELF STOWING BANDS

BACKGROUND OF THE INVENTION

1. Field of the Invention

The present invention relates to a submarine weapon handling system, and more particularly relates to a plurality of lightweight dollies movably attached to the submarine, each having a self storing securing band for securing a weapon thereto.

2. Description of the Prior Art

Weapon dollies currently being used in submarines for handling weapons such as torpedos, mines, and missiles or the like are provided to secure the weapon to the submarine and to transport the weapons along tracks for transfer into a selected launching tube. Five dollies are provided to support each weapon and each dolly is moved by conventional power assist means in the submarine aided by four to six men which move the dollies along tracks in order to place the dollies in position to receive a weapon, and move the weapon into position to be stored or loaded into a selected launch tube. However, each prior art weapon dolly is of two piece construction and includes a dolly body and a lashing strap having a total weight of about 140 pounds. The two pieces of the prior art weapon dolly must be handled manually, and must be stowed as separate pieces when not in use.

SUMMARY OF THE INVENTION

In accordance with the present invention each weapon dolly includes a body of a lightweight composite material rigidly secured to a steel frame. The composite material has a substantially semicylindrical or arcuate weapon supporting surface which is recessed to slidably receive a substantially semicylindrical or arcuate securing band. A cylindrical portion of the weapon is encompassed by the semicylindrical body and the semicylindrical band which are then clamped around the weapon to secure the weapon to the dolly. When it is desired to release the weapon, the band of each dolly is unclamped and is rotated into the recess for storage within the body. Five dollies are preferably used to secure a weapon to the submarine.

BRIEF DESCRIPTION OF THE DRAWINGS

FIG. 1 is a perspective of the dolly of the present invention shown in the weapon clamping position.

FIG. 6 is an enlarged operational view showing one of the band clamping mechanisms in two operative positions.

DESCRIPTION OF THE PREFERRED EMBODIMENT

Figure 3:
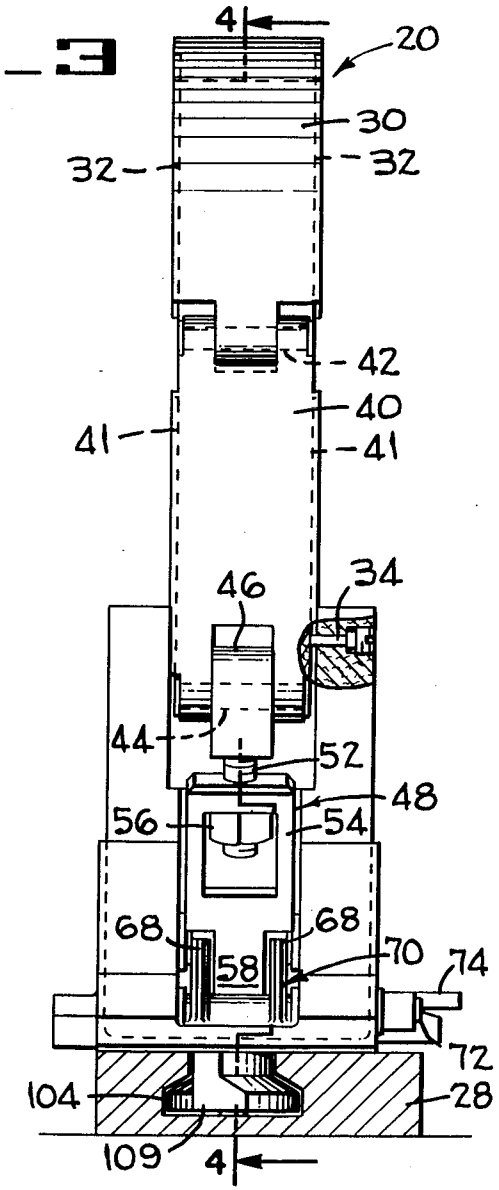
FIG. 3 is a side view of FIG. 2 looking in the direction of arrows 3—3 of FIG. 2.

Each weapon dolly 20 (FIGS. 1—3) of the present invention comprises a base body 22 having a generally concave or arcuate weapon supporting surface 24 formed from a light weight composite material 25 that is secured to a steel frame 26 slidably supported on a track 28 secured to the floor of the submarine (not shown). A substantially semicylindrical or arcuate band 30 formed from composite material is provided with a pair of arcuate slots 32 (only one shown in FIG. 1) to slidably receive the free ends of a plurality of guide pins 34 secured to the composite body 22. The band 30 is movable between a weapon clamping position illustrated in FIGS. 1–4 and a stowed position within a recess 38 illustrated in FIG. 5. A pair of arcuate links 40 having arcuate slots 41 therein (FIGS. 1–3) are formed from composite material and are pivotally connected to each end of the band 30 by pivot pins 42. The free ends of each link 40 has a clamping pin 44 secured, thereto for receiving associated hooks 46 of band clamping means or latching assemblies 48 when the bands secure a weapon W (FIG. 7) to the body of the dolly 20.

Figure 4:
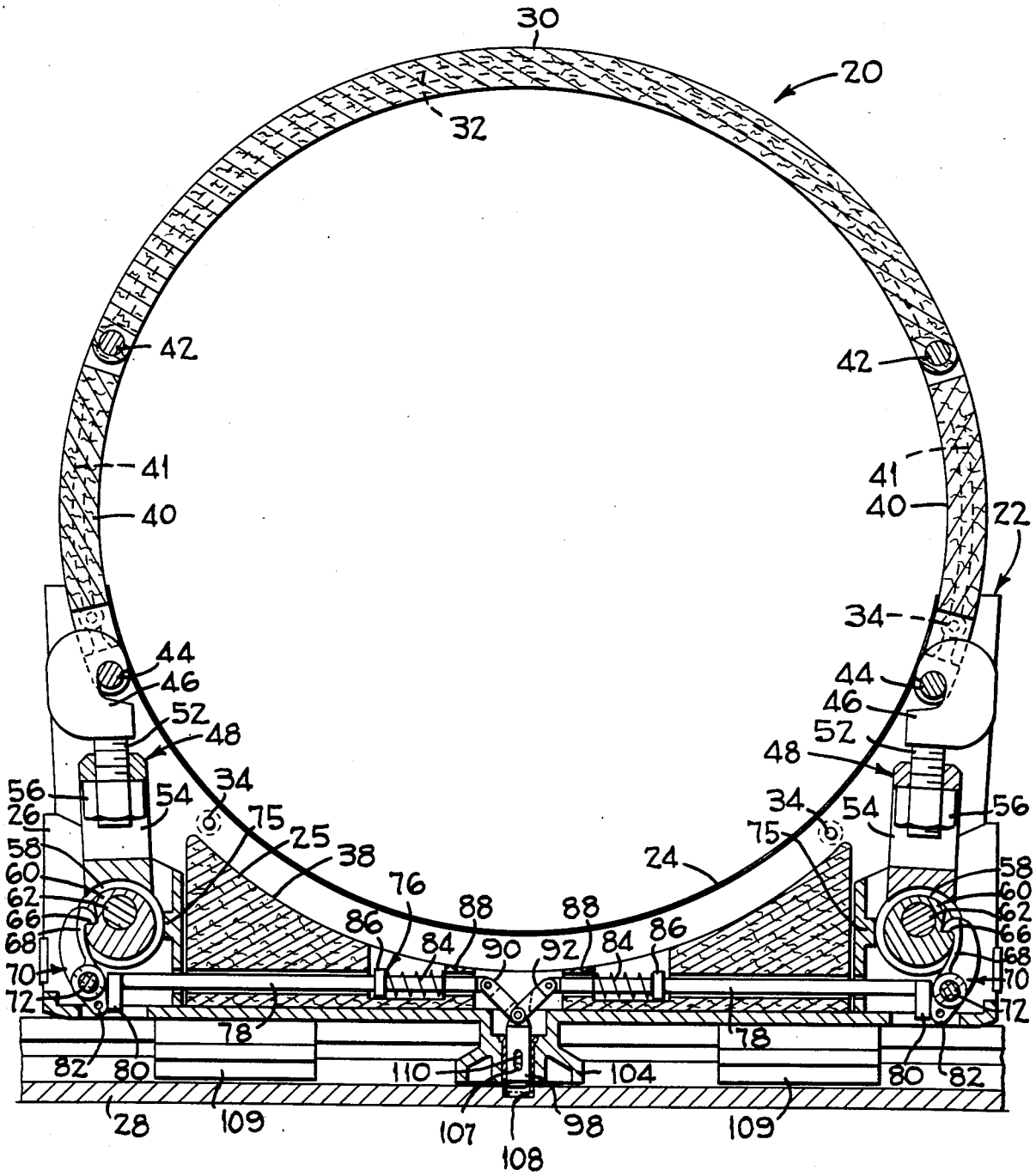
FIG. 4 is a section taken along lines 4—4 of FIG. 3 illustrating the metal and composite portions of the dolly with the weapon securing band in the weapon securing position.

As best shown in FIGS. 3 and 4, each band latch assembly 48 comprises the hook 46 which has a threaded shank 52 that extends through a hole in the upper wall of a link 54 and is adjustably connected thereto by a nut 56. The link includes a hub 58 which is rotatably received on an eccentric cam 60 that is secured to a shaft 62. The shaft is journaled in the steel frame 26 of the body 22.

Each eccentric cam 60 has a pair of locking slots 66 therein which are engaged by a pair of cam hooks 68 (FIG. 3) of a latch arm assembly 70 when the hooks 46 are in clamping engagement with the associated pin 44 and when the eccentric cams 60 are positioned to maintain the band latch assemblies in their lowermost position all as indicated in FIG. 4. Each latch arm assembly 70 is pinned to a shaft 72 which is journaled in the steel frame 26 and has a release lever 74 secured to the outer end of the shaft. When the band latching assemblies 48 are in their latched positions as illustrated in FIG. 4, it will be noted that each eccentric cam 60 is latched in its lowermost position and that the hub 58 contacts an abutment 75 of the steel frame 26 thereby preventing rotation of the cams in either direction.

In order to assure that the hooks 68 cannot be accidentally released unless the dolly 20 is moved to a predetermined weapon receiving or releasing position, a latch locking mechanism 76 (FIGS. 4–5) is provided.

The latch locking mechanism 76 includes a pair of rods 78, each having a shoe 80 on its outer end which is urged against a heel 82 on the associated latch arm assembly 70 by a spring 84. Each spring is disposed between a collar 86 pinned to the associated rod 78 and a flange 88 of the composite body 22. The inner ends of the rods 78 are pivotally connected to links 90,92; and the two links are pivotally connected to a locking pin 98. The locking pin 98 is slidably received in an annular guide 104 rigidly secured to the bottom of the steel frame 26 and slidably received in the conventional track 28 secured to the floor of the submarine (not shown). A pin 107 extends through a slot 110 in the locking pin 98 and is secured to the annular guide 104 to limit the amount of vertical movement of the locking pin 98. The annular guide 104 and a pair of linear guides 109 secured to the frame 26 cooperate to guide the dolly 20 when moved along the track 28.

As illustrated in FIG. 4, the springs 84 normally hold the bottom of the locking pin above the bottom of the track 28. The bottom of the track thus prevents the locking pin 98 from moving downwardly thereby maintaining the hooks 68 in the locking slot 66 of the associated cams 60. However, when the dolly 20 is moved along the track 28 to a weapon loading, unloading, or storing position the locking pin 98 becomes positioned over a hole 108 in the floor or bottom of the track 28. The handles 74 are then moved upwardly by any suitable means such as hydraulic cylinders from the locking position illustrated in FIG. 1 to positions which disconnect the hooks 68 from the slots 66 in the eccentric cam 60 as shown by dotted lines in FIG. 5. The eccentric cams 60 are then free to rotate away from the abutments 75 in response to an operator rotating shafts 62 (FIG. 5) upwardly out of engagement with the pins 44. The band 30 and one arcuate link 40 are then manually rotated into the recess 38 to their stowed position as shown in FIG. 5.

Figure 5:
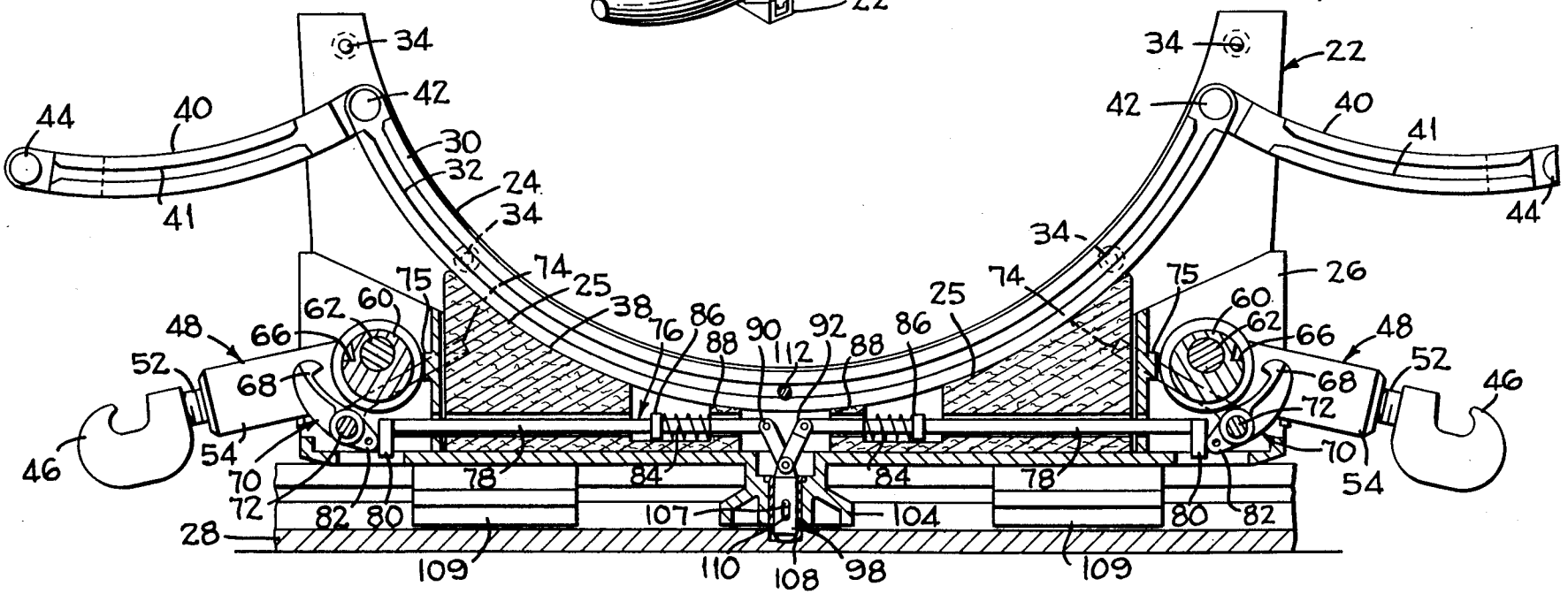
FIG. 5 is similar to FIG. 4 but with the band shown in full and with the band unclamped from the weapon and rotated into its inoperative position stowed in the dolly.

A spring loaded band lock 110 (FIGS. 1 and 2) is secured to the composite material 25 of the body 22 and include a pin 112 which is spring urged into a hole in the band 30 to lock the band in centered position when stowed in the base 22 as shown in FIG. 5.

Figure 7:
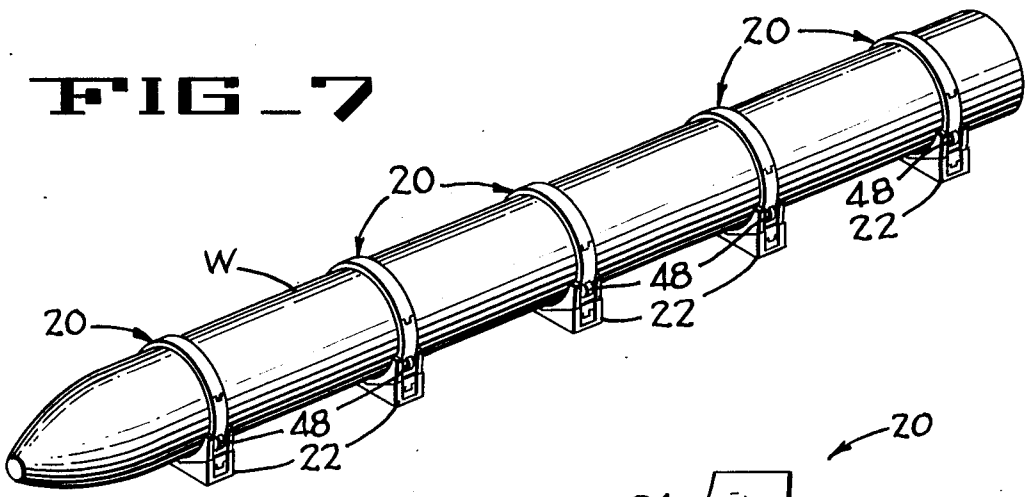
FIG. 7 is a diagrammatic perspective of a weapon clamped within five dollies.

In operation, the weapon dollies 20 of the present invention are positioned to receive the weapon when their bands 30 are stowed within the recess 38 in the composite material of the associated concave bodies 22. As illustrated in FIG. 7, five dollies are preferably used for supporting the weapon W. The weapon is then placed in the body with the aid of a hoist or the like (not shown). One or more operators then release the spring loaded lock pins 110 (FIG. 2) and rotate the bands out of the recess 38 in each dolly 20 and rotate the handle 74 out of the illustrated locking position (FIG. 1) thereby releasing the hook 68 from the locking slots 66 in the eccentric cams 60 if not already unlocked. The operators then connect the hooks 46 onto the associated pins 44 by raising the hooks thereby rotating the eccentric cams 180° from the positions illustrated in FIG. 4, and then pivot the hooks 46 inwardly over the pins 44. Assuming that the nuts 56 (FIG. 3) on the hook spindles are already adjusted into proper position for clamping the weapon W, the operator merely rotates shafts 62 (FIG. 6) to rotate cam 60 until the latch arm locking hooks 68 engage the cam slots 66 as shown in FIG. 4. The operator or operators are provided with wrenches (not shown) which engage sockets 67 (FIG. 1) in one end of the shafts 62 for this purpose. When the hooks 68 are released, the cams 60 automatically rotate to their released positions.

Figure 2:
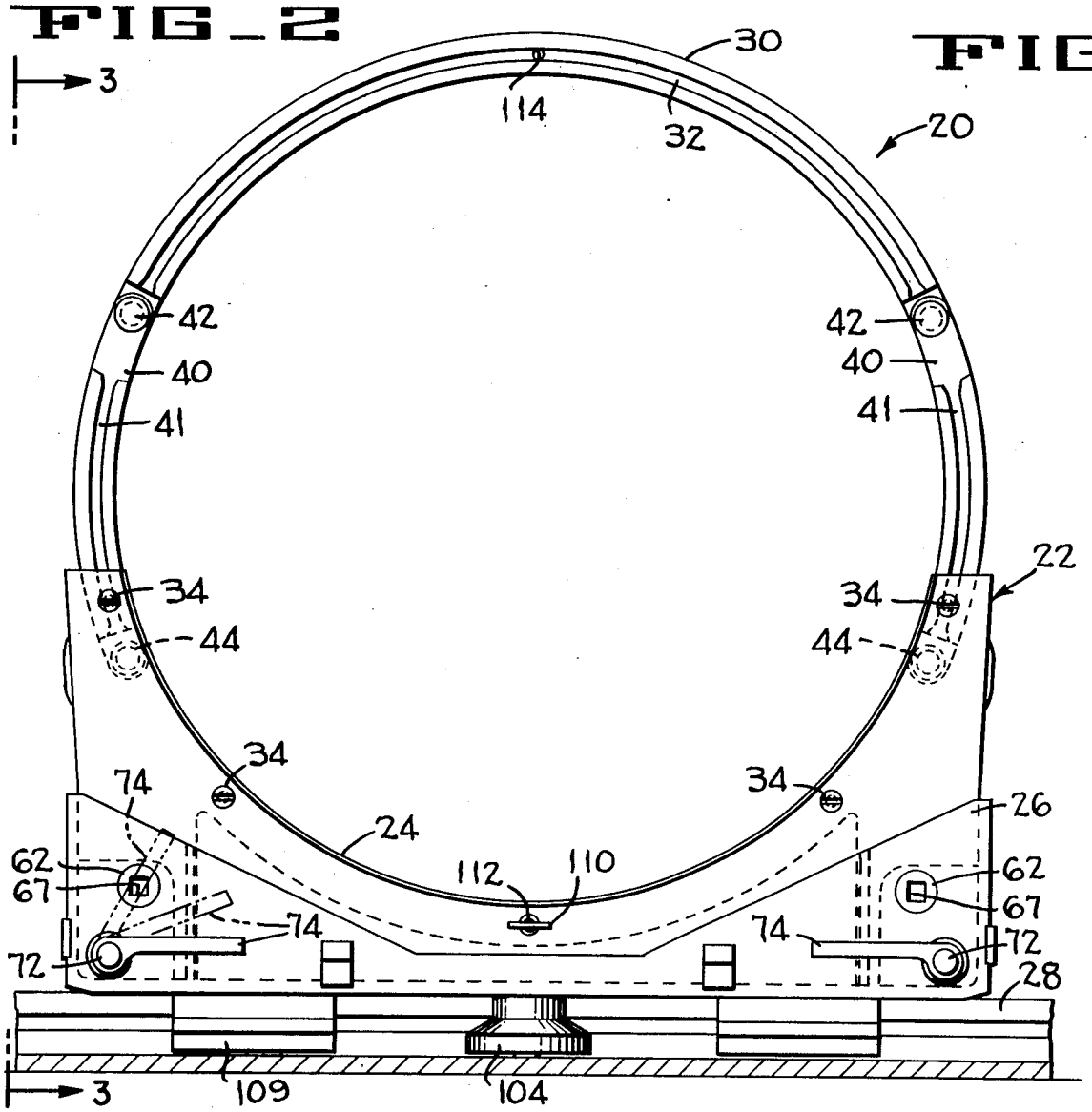
FIG. 2 is an elevation of the dolly looking in the direction of arrows 2—2 of FIG. 1.

The dollies and attached weapon W may then be moved, with the aid of power assist mechanisms (not shown) into a storage area; or may be moved into position for loading the weapon into a launching tube such as a torpedo tube or the like (not shown). When the weapon is in a stowed position, the dolly locking pin 98 is held in its upper band locking position by springs 84 (FIG. 4), with the lower end of the pin 98 positioned a slight distance above the bottom of the track 28 as illustrated in FIG. 2 thereby preventing the bands 30 from being accidentally released. When the weapon W is to be removed from its supporting dollies, the dollies must be positioned at a predetermined location with the locking pins 98 in alignment with holes 108 (FIGS. 4 and 5) in the tracks 28 thus permitting the pins 98 to move downwardly into the holes 108 in response to pivoting the handles 74 upwardly. The hooks 46 are then moved out of engagement with the clamp pins 44 thereby allowing the bands 30 to be rotated into and stored within the recesses 38 in the composite material of the body 22 at which time the arcuate links 40 and the band latch assembly 48 will assume the position shown in FIG. 5. The weapon W may then be removed from the dollies 20 by conventional means (not shown).

From the foregoing description it is apparent that the weapon dollies of the present invention are useable in submarines for securing weapons thereto when in storage, and also when being moved to a predetermined position to be transferred into a launching tube or the like by conventional equipment within the submarine. Since lightweight composite materials are used in the body and band of the dollies, the weight of each dolly is only about 53 percent of that of the prior art dollies; and since the band of each dolly may be stored in the body of the dolly when not in use, a space saving of about 25 percent is made possible when using the dolly of the present invention as compared to the prior art dollies.

Although the best mode contemplated for carrying out the present invention has been herein shown and described, it will be apparent that modification and variation may be made without departing from what is regarded to be the subject matter of the invention.

What is claimed is:

1. A weapon dolly, comprising:

means defining a base having a first continuous concave weapon engaging surface;

means defining a recess formed in said first concave surface;

means defining a rigid band of sufficient thickness to maintain a second concave weapon engaging surface in a predetermined arcuate shape while moving between a stowed position within said recess and a weapon clamping position with said first and second concave surfaces facing each other;

guide means between said base means and said band means for guiding and maintaining a portion of said band within said recess in said base when in said stowed position; and at least one clamping means connecting said band to said base when said band is in said weapon clamping position.

2. An apparatus according to claim 1 wherein said first and second concave surfaces are defined by rigid preformed cylindrical segments of light weight composite material.

3. A weapon dolly, comprising:

means defining a base having a first concave weapon engaging surface;

means defining a recess formed in said first concave surface;

means defining a band having a second concave weapon engaging surface movable between a stowed position within said recess and a weapon clamping position with said first and second concave surfaces facing each other;

guide means between said base means and said band means for maintaining said band within said recess in said base when in said stowed position;

at least one clamping means connecting said band to said base when said band is in said weapon clamping position;

said band means including arcuate side walls; and wherein said guide means comprises an arcuate groove means in said side walls and cooperating male means secured to said base means and entering said arcuate grooves.

4. An apparatus according to claim 1 wherein said means defining said recess is formed from composite material for minimizing the weight of said dolly and is of sufficient depth to encompass a portion of said rigid band therein outwardly of said weapon engaging surface of said first concave surface.

5. An apparatus according to claim 4 wherein said band means is formed from composite material.

6. An apparatus according to claim 1 wherein said band means is formed from composite material.

7. A weapon dolly, comprising: means defining a base having a first concave weapon engaging surface;

means defining a recess formed in said first concave surface;

means defining a band having a second concave weapon engaging surface movable between a stowed position within said recess and a weapon clamping position with said first and second concave surfaces facing each other;

guide means between said base means and said band means for maintaining said band means within said recess in said base means when in stowed position; and at least one clamping means connecting said band to said base when said band is in said weapon clamping position;

said clamping means comprising an eccentric cam journaled in said base for rotation about an axis and having a cam locking slot therein, a cam follower journaled on said eccentric cam, band hook means connected to said cam follower and adapted to be operatively connected to one end of said band for applying a weapon clamping force when said eccentric cam pivots said band hook means into said weapon clamping position, and cam hook means pivotally connected to said base and normally urged into said cam locking slot for maintaining said band hook means locked until manually released.

8. An apparatus according to claim 7 and additionally comprising track means for supporting said weapon dolly for movement along a path, guide means projecting downwardly from said base means into said track, said track means having a floor and having holes therein spaced at predetermined intervals, said cam hook means including a heel, a rod movably supported in said base means, resilient means normally urging said rod into engagement with said heel for urging said cam hook means slot into said locking slot, a locking pin connected to said rod and slidably received in said guide means, said locking pin being normally held above said floor of said track means by said resilient means, said floor of said track means positively maintaining said cam hook means in said cam locking slot to prevent release of said weapon until said dolly is moved into position wherein said locking pin is above a hole in said track.

9. An apparatus according to claim 8 wherein said cam hook means is secured to a cam hook shaft journaled in said base means; and a release lever secured to said shaft, said release lever being manually actuated to disengage said cam hook means from said cam locking slot only when the weapon dolly has been moved along said track to a position wherein said locking pin is disposed in position to enter one of said holes in said track means.

10. An apparatus according to claim 9 wherein said at least one of said clamping means is operatively connected to one end of said band means, and a second clamping means is operatively connected to the other end of said band means.

11. A weapon dolly, comprising:

means defining a base having a first concave weapon engaging surface;

means defining a recess formed in said first concave surface;

means defining a band having a second concave weapon engaging surface movable between a stowed position within said recess and a weapon clamping position with said first and second concave surfaces facing each other;

guide means between said base means and said band means for maintaining said band within said recess in said base when in said stowed position;

at least one clamping means connecting said band to said base when said band is in said weapon clamping position;

said band means having two end portions; and additionally comprising a pair of arcuate link means pivotally connected to said end portions, a hook engaging pin secured to each link means, and means for locking said band means in a centered position within said recess with portions of said arcuate link means pivoted outwardly of said base means for allowing a weapon to enter or be removed from said base means.

12. A weapon dolly for a submarine, comprising;

means defining a light weight base formed from a steel frame and a light weight composite body; said composite body including a first continuous arcuate weapon engaging surface;

means defining a recess formed in said first arcuate surface;

means defining a band formed from light weight composite material having a second predetermined arcuately shaped weapon engaging surface and having side walls, said band being movable between a weapon clamping position and a stowed position in said recess while retaining said second surface in said predetermined arcuate shape;

complementary band guiding means on said band and on said composite body for rotatably receiving and storing said band means within said recess to receive or discharge a weapon from the base means; and at least one clamping means connecting said band to said base when said band is in said weapon clamping position.

13. An apparatus according to claim 12 wherein the use of composite material in said weapon dolly substantially minimizes the weight of the dolly.

14. An apparatus according to claim 12 wherein said dolly with said band means stored in the recess means in said base means substantially reduces the storage area occupied by an empty dolly when stored.

15. A weapon dolly for a submarine, comprising;

means defining a light weight base formed from a steel frame and a composite body, said composite body including a first arcuate weapon engaging surface;

means defining a recess formed in said first arcuate surface;

means defining a band formed from composite material having a second arcuate weapon engaging surface and having side walls, said band being movable between a weapon clamping position and a stowed position in said recess;

complementary band guide means on said band and on said composite body for rotatably receiving and storing said band means within said recess to receive or discharge a weapon from said base means; and at least one clamping means connecting said band to said base when said band is in said weapon clamping position;

said complementary guide means being in the form of grooves formed in adjacent walls of said band means, and a plurality of pins secured to said composite body and entering said grooves formed in said side walls of said band means.

16. A weapon dolly for a submarine, comprising:

means defining a light weight base formed from a steel frame and a composite body, said composite body including a first arcuate weapon engaging surface;

means defining a recess formed in said first arcuate surface;

means defining a band formed from said composite material having a second arcuate weapon engaging surface and having side walls, said band being movable between a weapon clamping position and a stowed position in said recess;

complementary band guide means on said band and on said composite body for rotatably receiving and storing said band means within said recess to receive or discharge a weapon from the band means; and at least one clamping means connecting said band to said base when said band is in said weapon clamping position;

said clamping means comprises at least one eccentric cam journaled in said base means for rotation about an axis and having a locking slot therein, a cam follower journaled on said eccentric cam, hook means operatively connected between said cam follower and one end of said band means for applying a weapon clamping force along an axis when said eccentric cam pivots said hook to said weapon clamping position, abutment means on said base means for engaging said cam follower when said cam follower is in said weapon clamping position, and cam hook means pivotally connected to said base and normally urged into said locking slot, said weapon clamping force normally forcing the locking slot against said cam hook means and forcing the cam follower against said abutment.

17. An apparatus according to claim 16 and additionally comprising track means for supporting said weapon dolly for movement along a path, guide means projecting downwardly from said body means into said track, said track having a floor and having at least one hole therein, latch locking means including a heel on said cam hook means, a rod movably supported in said base means, a locking pin slidably received in said guide means, link means pivotally connecting said rod to said locking pin, and resilient means normally urging said rod into abutting engagement with said heel and maintaining said locking pin above said floor of said track means, said floor of said track means positively maintaining said cam hook means in said locking slot to prevent release of said weapon until said dolly is moved to a position wherein said lock pin is in alignment with said at least one hole.

18. An apparatus according to claim 17 and additionally comprising a cam hook shaft journaled in said base means, a release lever secured to said shaft, said release lever being manually actuated to release said cam hook from said cam locking slot only after the weapon dolly has been moved along said track to a position aligning said locking pin with said at least one hole in said track means.

19. An apparatus according to claim 18 wherein said at least one clamping means is operatively connected to one end of said band means, and a second clamping means is operatively connected to the other end of said band means.

20. An apparatus according to claim 15 and additionally comprising a pair of arcuate links pivotally secured to opposite end portions of said band means, each link means including second grooves formed in adjacent walls thereof defining continuations of said grooves in said band means, one of said second grooves receiving and being guided by said pins when said band means is moved into said stowed position within said recess.

21. An apparatus according to claim 20 and additionally comprising means for locking said band means in a centered position within said recess when in said stowed position.

22. An apparatus according to claim 21 wherein said link means are angled outwardly away from the center of said lightweight base means when in said stowed position for allowing a weapon to enter or be removed from said weapon dolly.

23. An apparatus according to claim 22 wherein a plurality of side by side weapon dollies are used to support a weapon.

24. A weapon dolly comprising:

means defining a base having a first concave weapon engaging surface;

means defining a recess formed in said first concave surface;

means defining an arcuate band defined by a central section and a pair of arcuate links together defining a second concave weapon engaging surface movable between a stowed position within said recess and a weapon clamping position with said first and second concave surfaces facing each other;

guide means between said base means and said band means for maintaining said band within said recess in said base when in said stowed position;

at least one clamping means connecting said band to said base when said band is in said weapon clamping position;

said central section of said band means, said arcuate links and said weapon engaging surface of said base means cooperate to define a cylindrically shaped clamp when in said weapon clamping position.

25. An apparatus for clamping a weapon having a cylindrical surface to a weapon dolly in a submarine for movement along a track between weapon receiving, weapon discharging and weapon stowing positions comprising:

track means secured to the submarine;

means for movably attaching said dolly to said track;

means in said dolly defining a base including a light weight composite body having a weapon supporting surface for engaging a portion of the cylindrical surface of the weapon and having a recess therein;

band means having an arcuate weapon engaging surface of substantially fixed radius slidably connected to said base and movable between a weapon clamping position externally of and opposed to said base for clamping the weapon to the base and a stowed position within said recess and spaced from the weapon when supported on said base, said radius of said weapon engaging surface being of substantially the same radius when in said stowed position;

arcuate link means pivotally secured to end portions of said band means and partially disposed within said recess when in said weapon clamping position; and means for releasably clamping said band means to said base means for rigidly securing said weapon to the submarine when said band is in said weapon clamping position. position.

26. An apparatus according to claim 25 wherein said band, said arcuate link, and a major portion of said base are formed from lightweight composite material to reduce the weight carried by the submarine.

27. An apparatus according to claim 26 wherein at least four weapon dollies are required for each weapon.

28. An apparatus according to claim 25 and additionally comprising band locking means for locking said band means in a centered position in said recess when said band means is in stowed position.

29. An apparatus according to claim 28 wherein said arcuate link means pivots outwardly of said body when said band is locked in said centered position thereby permitting the weapon to be lowered into and lifted out of said base section.

30. An apparatus for clamping a weapon having a cylindrical surface to a weapon dolly in a submarine for movement along a track between weapon receiving, weapon discharging and weapon stowing positions, comprising:

track means secured to the submarine;

means for movably attaching said dolly to said track;

means in said dolly defining a base including a light weight composite body having a weapon supporting surface for engaging a portion of the cylindrical surface of a weapon and having a recess therein;

band means slidably connected to said base and movable between a weapon clamping position externally of and opposed to said base for clamping the weapon to the base and a stowed position with said recess and spaced from the weapon when supported on said base;

arcuate link means pivotally secured to end portions of said band means and partially disposed within said recess when in said weapon clamping position;

means for releasably clamping said band means to said base means for rigidly securing said weapon to the submarine when said band is in said weapon clamping position;

said clamping means including an eccentric cam with locking slots therein, cam locking hooks engageable with said locking slots when said clamp means is in weapon clamping position, and operator controlled means for locking and releasing said clamp means.

* * * * *